United States Patent [19]

Carberry

[11] Patent Number: 4,826,024

[45] Date of Patent: May 2, 1989

[54] GANTRY CRANE FOR MAINTENANCE OF INCINERATORS AND THE LIKE

[76] Inventor: Victor V. Carberry, N55 W21404 Logan Dr., Menomonee Falls, Wis. 53051

[21] Appl. No.: 140,987

[22] Filed: Jan. 5, 1988

[51] Int. Cl.[4] ..... B66C 19/00

[52] U.S. Cl. ..... 212/208; 212/166; 212/218; 212/220

[58] Field of Search ..... 212/205, 208, 213, 218, 212/219, 220, 221, 175, 166; 29/426.1

[56] References Cited

U.S. PATENT DOCUMENTS

| | | | |
|---|---|---|---|
| 910,038 | 1/1909 | Andrews | 212/218 |
| 1,614,769 | 1/1927 | Amsler | 212/205 |
| 1,952,238 | 3/1934 | Dice | 212/218 |
| 3,826,196 | 7/1974 | Wallace | 212/218 |
| 4,648,647 | 3/1987 | Patton | 212/218 |
| 4,715,762 | 12/1987 | Lanigan | 212/220 |

FOREIGN PATENT DOCUMENTS

| | | | |
|---|---|---|---|
| 314429 | 6/1956 | Switzerland | 212/218 |

*Primary Examiner*—Sherman D. Basinger
*Assistant Examiner*—Stephen P. Avila
*Attorney, Agent, or Firm*—Michael, Best & Friedrich

[57] ABSTRACT

A gantry crane for facilitating the installation and removal of cast iron hearth plates in a refractory incinerator includes an elongate rectangular frame assembly having parallel side and parallel end members. An elongate central beam, positioned between and parallel to the side members, is movable along the end members, and a user-actuable lift mechanism is mounted for movement along the central beam. A plurality of support legs support the frame assembly above the hearth plates within the incinerator, and the lift mechanism is positioned over the individual hearth plates by adjusting the positions of both the central beam along the end members and the lift mechanism along the central beam. After raising a hearth plate, the plate can be removed from the incinerator by moving the lift mechanism along the central beam and the central beam along the end members. The size of the gantry crane is adjustable so as to permit use within similarly designed incinerators of various sizes and shapes. A vertically movable door, at one end of the incinerator, can be utilized to engage the gantry crane and thereby secure the crane within the incinerator.

19 Claims, 2 Drawing Sheets

GANTRY CRANE FOR MAINTENANCE OF INCINERATORS AND THE LIKE

BACKGROUND OF THE INVENTION

This invention relates generally to lifting devices, and more particularly, to gantry cranes for vertically raising and laterally transporting heavy objects.

Large refractory incinerators typically include a cylindrical housing having one end provided with a large access door and an opposite end provided with a smaller, vertically movable door through which waste matter can be introduced into the interior of the incinerator. Typically, a hydraulically operated ram, in conjunction with a waste receiving hopper, operates to force waste matter from the hopper through the vertically movable door and into the interior of the incinerator. Within the cylindrical housing, a plurality of generally rectangular, foraminous cast iron hearth plates from a horizontal floor onto which the waste matter is deposited for incineration. Air is introduced through passageways into the interior of the incinerator under the hearth plates to promote combustion of the refuse. Preferably, the hearth plates sealingly engage the interior of the oven and each other so that the space beneath the plates can be pressurized. Air jets are positioned in the cast iron floor and air is conveyed upwardly through the perforations in the individual cast iron plates so as to promote incineration of the burning waste matter.

Proper combustion of the waste matter, and proper operation of the incinerator, is best achieved by keeping the holes in the cast iron plates as well as the air passageways under the plates clear and clean. Because the air passageways under the plates are susceptible to being clogged with ash and other debris as the incinerator is used, special attention must be given to assuring that the cast iron plates are thoroughly cleaned when the accumulated ash is, from time to time, removed from the interior of the incinerator.

In order to assure thorough cleaning of the air passageways under the cast iron hearth plates, the plates are best removed from the interior of the incinerator during such cleaning. Heretofore, this has been performed by first threading a lifting lug into a threaded socket formed adjacent the center of each plate and thereafter manually lifting and carrying the plate from the interior of the incinerator. Because the threaded holes may not be located at the actual center of gravity of each plate, the plates can shift as they are lifted, thereby complicating their removal. Furthermore, as the cast iron plates may weigh in excess of 200 lbs. each, considerable effort and time can be expended in removing the plates and thereafter reinstalling the plates within the incinerator.

In view of the foregoing, it is a general object of the present invention to provide an apparatus for facilitating the removal and installation of cast iron hearth plates in a refractory incinerator.

It is a more specific object of the present invention to provide an apparatus for facilitating the removal and installation of cast iron hearth plates within a refractory incinerator so that the cast iron plates can be quickly and easily removed from, and reinstalled in, the incinerator with a minimum of physical effort and a maximum of safety.

It is a still more specific object of the present invention to provide an apparatus for facilitating the removal and installation of cast iron plates in a refractory incinerator wherein the apparatus can be readily adapted for use with incinerators of various sizes and shapes.

SUMMARY OF THE INVENTION

The invention is directed to a gantry crane for facilitating the removal and installation of hearth plates in an incinerator of the type including an elongate housing, a door mounted for vertical movement at one end of the housing, another door at the other end of the housing, and a plurality of the hearth plates arranged to form a floor within the elongate housing, the gantry crane comprising a user-actuable lift mechanism, adapted to individually engage and raise the hearth plates, and means insertable into the housing for suspending the lift mechanism over the hearth plates and for permitting lateral movement of the lift mechanism over the hearth plates.

The invention is also directed to a gantry crane comprising an elongate central beam which supports a lifting means for engaging and raising the load to be lifted, the lifting means being supported by a trolley for movement along the central beam. Opposite ends of the elongate central beam are also supported by trolleys, each trolley being supported for movement along one of a pair of substantially parallel elongate side members. Support means are provided for supporting the opposite ends of the end members such that the lifting means is above a load to be lifted.

A principal feature of the present invention is the provision of a crane mechanism which can be readily assembled within a refractory incinerator and used to vertically lift and horizontally transport cast iron hearth plates into and out of the interior of the incinerator. The crane mechanism can be assembled by a pair of workmen in a short period of time and is also readily disassembled for removal from the incinerator. The crane is also comprised of a number of components of convenient size so that it can be easily transported from one incinerator repair job to another.

Another principal feature of the present invention is the provision of a gantry crane whose dimensions can be adjusted so as to fit within the interiors of refractory incinerators of various sizes and shapes.

Still another principal feature of the present invention is the provision of a gantry crane which can be inserted through an access door at one end of a refractory incinerator and retained in position by means of engagement with a smaller, vertically movable door located at the other end of the incinerator.

BRIEF DESCRIPTION OF THE DRAWINGS

The feature of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figures 1, 5:
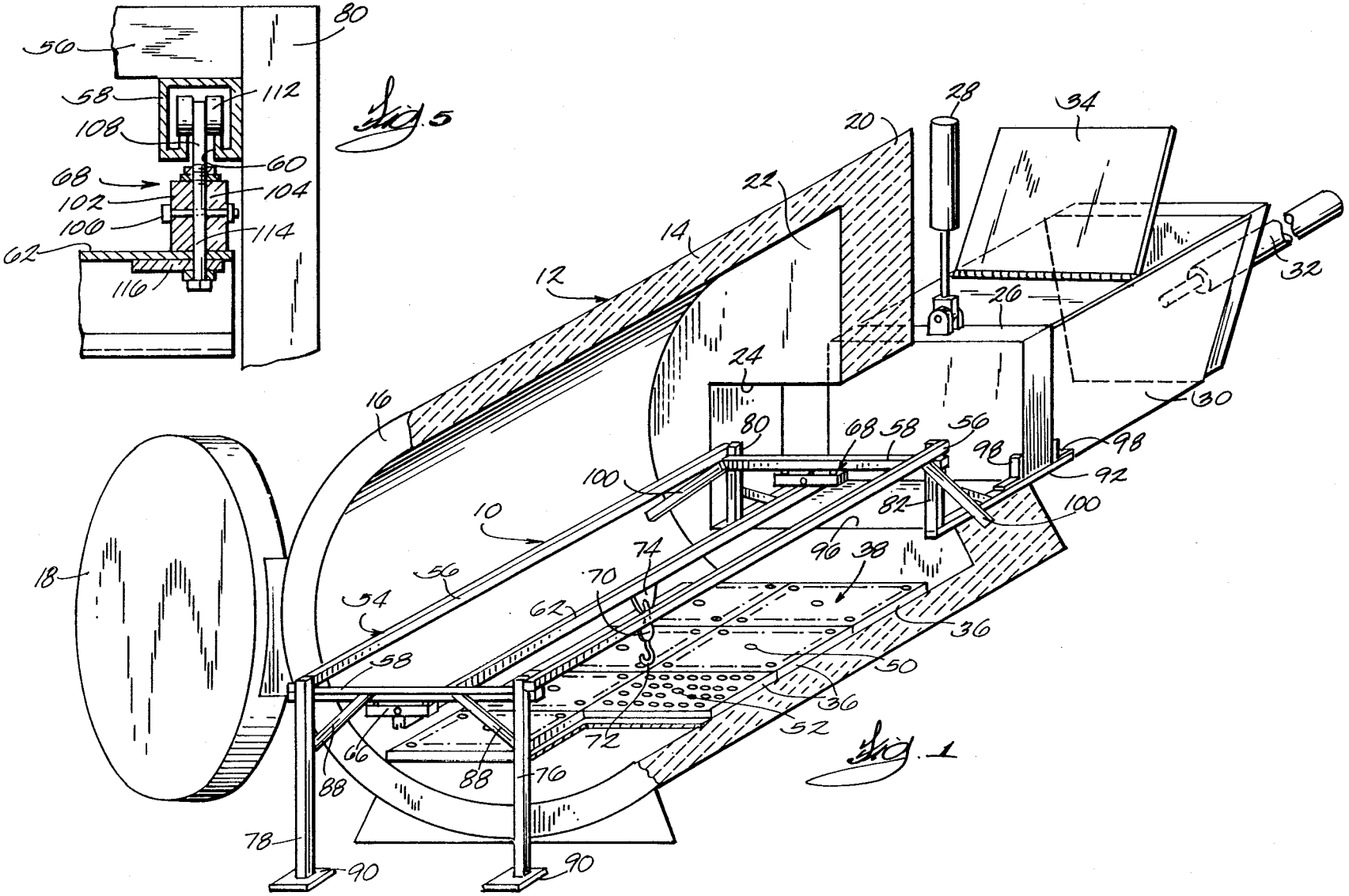
FIG. 1 is a perspective view, partially in section, of a cylindrical refractory incinerator having therein positioned a gantry crane embodying various features of the invention.
FIG. 5 is a cross-sectional view of a portion of the gantry crane shown in FIG. 2 taken along line 5—5 thereof.

Referring to the drawings, and, in particular, to FIG. 1, a ganry crane 10 embodying various features of the invention is shown mounted within the interior of a refractory incinerator 12. In accordance with conventional practice, the refractory incinerator 12 comprises an elongate, substantially cylindrical housing or chamber 14 comprising a steel casing lined with refractory brick. One end 16 of the housing 14 includes a relatively large access door 18, while the opposite end 20 of the housing 14 includes an end wall 22 having therein formed a substantially rectangular inlet opening 24. A substantially rectangular, vertically movable door 26 is mounted adjacent the end 20 of the incinerator housing 14 and is raised and lowered by means of a hydraulic cylinder 28 so as to selectively open and close the inlet opening 24 to the interior of the incinerator 12. A hopper 30, adapted to receive waste materials to be incinerated, is mounted adjacent the inlet opening 24 to the incinerator 12 and includes a hydraulically actuated rim 32 for forcing waste matter through the inlet and into the incinerator when the vertically movable door 26 is raised. Waste matter is deposited into the hopper through a hinged, top-mounted cover plate 34.

Within the cylindrical housing 14, the incinerator 12 includes a plurality of generally rectangular, foraminous cast iron hearth plates 36 arranged to form a substantially planar floor 38 within the incinerator 12 onto which waste matter to be incinerated is deposited after being forced through the inlet 24. Two air passageways (not shown) are located beneath the cast iron hearth plates 36 so as to allow air to flow upwardly through the holes of the hearth plates and into the waste matter to promote incineration of the waste matter resting thereon. Preferably, the cast iron hearth plates 36 sealingly engage the interior of the incinerator housing 14 and each other so as to form a pressurizable space within the housing. In addition, each plate 36 preferably includes a centrally disposed threaded socket 50 into which a lifting lug 52 can be inserted so as to provide a means by which the plate 36 can be engaged and raised.

To facilitate the convenient removal and reinstallation of the hearth plates 36 during cleaning, the gantry crane 10 functions to vertically raise individual ones of the hearth plates 36 and thereafter laterally transport the plates 36 out the open end 16 of the incinerator housing 14 for cleaning. Following cleaning, the gantry crane 10 operates to raise the hearth plates 36, transport the hearth plates 36 laterally into the incinerator housing 14, and thereafter lower the plates 36 into their proper positions within the incinerator housing 14.

Figure 3:
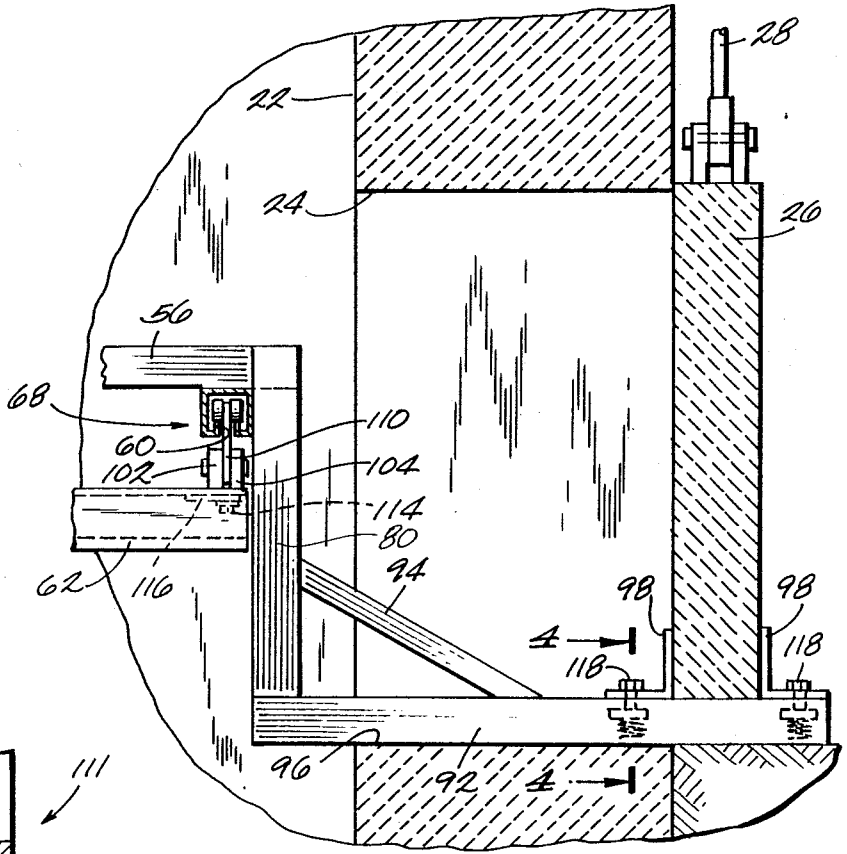
FIG. 3 is a fragmentary side elevational view of one end of the gantry crane illustrated in FIG. 1 showing the engagement of a vertically movable door with one end of the gantry crane so as to secure the gantry crane within the incinerator.
Figure 2:
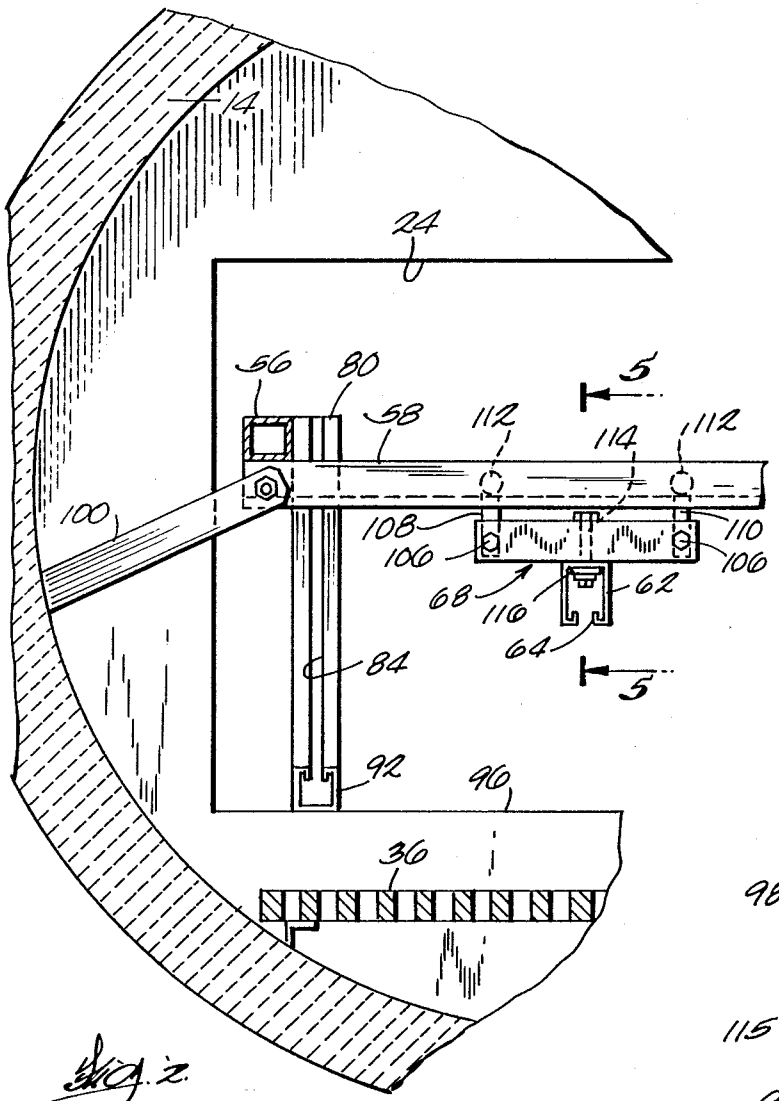
FIG. 2 is a fragmentary cross-sectional view of the incinerator and gantry crane shown in FIG. 1 taken along line 2—2 thereof.

As illustrated in FIG. 1, the gantry crane comprises a generally rectangular frame assembly 54 having a pair of elongate, substantially parallel, side members 56 and a pair of elongate, substantially parallel, end members 58 extending between the ends of the parallel side members 56. Preferably, each of the side members 56 is formed of a cold rolled steel or aluminum framing member having a substantially square cross-section as illustrated in FIG. 2. The end members 58 are preferably formed of cold rolled steel or aluminum framing members having a substantially square or rectangular cross-section including a longitudinally extending slot 60 as shown in FIG. 3.

The gantry crane 10 further includes an elongate central beam 62 positioned substantially between and parallel to the two side members 56. Preferably, the central beam 62 is formed of a cold rolled steel or aluminum framing member having a substantially square or rectangular cross-section including a bottom longitudinally extending slot 64 as shown in FIG. 2. A pair of trolley mechanisms 66 and 68, adapted to hang from and move along each of the end members 58 of the frame assembly 54, are mounted to either end of the central beam 62 so that the central beam 62 is suspended from, and movable from side to side along, the frame assembly 54 in a direction perpendicular to the longitudinal axis of the incinerator housing 14.

In accordance with one aspect of the invention, the gantry crane 10 includes lifting means, mounted to and movable along the central beam 62, for engaging and raising the load to be lifted. Preferably, such lifting means comprises a user-actuable, powered or manually operated, winch, lift or pulley mechanism 70 having a downwardly depending hook or latch 72 adapted to engage the lifting lug 52 coupled to one of the cast iron hearth plates 36. The winch or pulley mechanism 70 is mounted for lateral movement along the central beam 62 by means of an additional trolley mechanism 74, which can be similar in construction and operation to the trolley mechanisms 66 and 68 supporting the ends of the central beam 62.

Preferably, the gantry crane 10 is of sufficient length to extend from the inlet 24 through the open access door 18 so that the heart plates 36 can be transported along the central beam 62 and out of the housing 14.

The frame assembly 54, together with the central beam 62 and the winch or pulley mechanism 70, is suspended above the cast iron hearth plates 36 within the incinerator 12 by means of downwardly depending legs or supports 76, 78, 80 and 82 disposed adjacent the corners of the rectangular frame assembly 54. Preferably, each of the leg members 76, 78, 80 and 82 is formed of a cold rolled steel or aluminum framing member having a substantially square or rectangular cross-section and including a longitudinal slot 84 as shown in FIG. 2. As best seen in FIG. 1, two of the leg members 76 and 78, positioned nearest the access door 18 of the incinerator 12, are of sufficient length to engage the ground beneath the incinerator 12 and support the frame assembly 54 at a convenient working height above the cast iron hearth plates 36. A pair of braces 88, mounted diagonally between the leg members 76 and 78 and the end member 58, provide rigidity and support to the gantry crane 10. Preferably, a generally rectangular load dispersing pad 90 is mounted to the lowermost end of each of the leg members 76 and 78 supporting the end of the frame assembly 54 nearest the access door 18.

The leg members 80 and 82, supporting the end of the frame assembly 54 opposite the access door 18, are relatively shorter than the opposite leg members 76 and 78 and each include a horizontal lower extension 92 dimensioned to extend through the rectangular inlet 24.

Preferably, each extension is joined to the adjacent leg member 80 and 82 by means of welding. As illustrated, the horizontal extensions 92 rest on a horizontal surface or ledge 96 formed by the rectangular inlet 24, and the length of the relatively shorter leg members 80 and 82 is such that the frame assembly 54 is substantially horizontally level within the incinerator 12 when the gantry crane 10 is positioned within the incinerator as illustrated.

In order to securely support the gantry crane 10 within the incinerator 12 when the cast iron hearth plates 36 are to be removed or installed, the horizontal extensions 92 are of sufficient length to extend fully through the rectangular inlet 24 and under the lowermost edge of the vertically movable, hydraulically raised, inlet door 26. After the gantry crane 10 is positioned within the incinerator 12 as illustrated, the vertically movable door 26 can be lowered onto the horizontal extensions 92 to firmly clamp the gantry crane 10 in position within the incinerator 12. Preferably, a pair of opposed right angle flanges 98, spaced by a distance substantially equal to the width of the vertically movable door 26, are mounted to each of the horizontal extensions 92 so as to receive the lower edge of the vertically movable door 26 when the door is lowered as best seen in FIG. 3.

Further support of the frame assembly within the incinerator is provided by means of a pair of elongate brace members 100 which are hingedly joined at one end to the ends of the elongate end member 58 as best seen in FIG. 2. During installation of the gantry crane 10 within the incinerator 12, the hinged brace members 100 can be swung outwardly into contact with the interior of the incinerator 12 to provide additional support to the gantry crane 10.

As best seen in FIGS. 1, 2, 3 and 5, each of the trolley mechanisms 66 and 68 at the ends of the central cross beam 62 comprises an elongate member formed of a pair of parallel, elongate plates 102 and 104 held together by means of a bolt 106 at each end. A pair upwardly extending hanger members 108 and 110 are positioned between the plates 102 and 108 and are held in place by the bolts 106. Each of the hanger members 108 and 110 is dimensioned to extend through the slot 60 formed in the end members 58, and carries at least a pair of journalled wheels 112 on either side adapted to ride within the interior of the end member 58 on flanges 108 formed on either side of the slot 60.

Each of the trolley mechanisms 66 and 68 is mounted to one end of the central cross beam 62 by means of an upwardly extending bolt 114 as illustrated. Preferably a reinforcing plate 116 is positioned between the head of the bolt 114 and the cross beam 62, and the bolt is not drawn up tightly in order to permit the beam 62 to flex slightly relative to the trolleys under the influence of the load.

Figure 4:
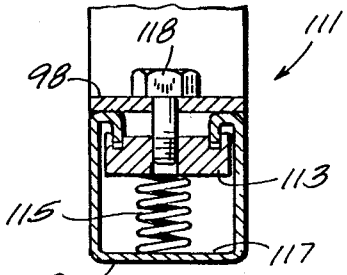
FIG. 4 is a cross-sectional view of a portion of the gantry crane shown in FIG. 3 taken along line 4—4 thereof.

To facilitate use of the gantry crane 10 within incinerators of various sizes and shapes, the various side members 56, end members 18, leg members 76, 78, 80 and 82, and flange members 94 and 98 are preferably comprised of lengths of channel of the type manufactured by B-Line Systems of Highland, Illinois, and the connections between the various members are preferably arranged so as to be adjustable and thereby permit adjustment of the length, width and height of the gantry crane 10. To this end, the connections between the various hollow slotted framing members are made by means of releasable and adjustable channel fasteners 111 such as "Twirl Nuts" manufactured by B-Line Systems, Inc. of Highland, Ill. Such a fastener 111 is illustrated in FIG. 4 and comprises an internally threaded plate or nut 113 which is positioned within the interior of the slotted member or channel, such as the extension 92, and is biased against the interior of the slotted member 92 by means of a coil spring 115 engaging the threaded nut 113 and an interior wall 117 of the member. An externally threaded fastener 118 for securing an adjacent member, such as the flange 98, to the slotted member 92, extends through the adjacent member 98 and threadedly engages the threaded nut 113. By tightening the threaded fastener 118, the adjacent member 98 can be firmly attached to the slotted member 92. By loosening the threaded fastener 118 and thereafter sliding the "Twirl Nut" 111 along the interior of the slotted member, the connection point to the slotted member can be adjusted.

The gantry crane 10 shown and described herein is well suited for use in removing and installing the cast iron hearth plates 36 of a refractory incinerator. In particular, the gantry crane is light weight, easily and economically manufactured, easily assembled and disassembled, and can be readily installed and removed from the interior of a refractory incinerator 12. In addition, the gantry crane 10 greatly reduces the physical effort required to lift the cast iron hearth plates 36 and transport the plates into or out of the incinerator 12.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. A gantry crane for facilitating the removal and installation of hearth plates in an incinerator of the type including an elongate housing having opposite ends and a longitudinal axis, a door mounted for vertical movement at one end of the housing, another door at the other end of the housing, and a plurality of the hearth plates arranged to form a floor within the elongate housing, said gantry crane comprising:

a user-actuable lift mechanism adapted to individually engage and raise the hearth plates; and means insertable into the housing for suspending said user-actuable lift mechanism over the hearth plates and for permitting lateral movement of said user-actuable lift mechanism over the hearth plates;

said means insertable into the housing for suspending comprising an elongate frame assembly adapted to extend through the elongate housing from substantially the door mounted for vertical movement at one end of the housing to the other end of the housing;

said elongate frame being adapted to extend substantially along the length of the housing and including a movable beam oriented substantially parallel to the longitudinal axis of the housing and movable from side-to-side within the housing in a direction substantially perpendicular to the longitudinal axis of the housing;

said user actuable lift mechanism being mounted for movement along said elongate beam;

said suspending means being adapted so that said elongate beam remains a substantially constant distance above the floor formed by the hearth plates within the elongate housing as the elongate beam moves from side-to-side within the housing;

said elongate beam being of sufficient length to extend through the other end of the housing so that hearth plates raised by said user-actuable lift member can be transported along said elongate beam and out of the housing;

said suspending means being adapted to be engaged by a door mounted for vertical movement at one end of the housing so as to be firmly retained within the housing;

said suspending means including, at one end, a pair of downwardly depending leg members each having a horizontal extension adapted to extend under the door mounted for vertical movement and to be engaged by the door mounted for vertical movement when said gantry crane is positioned within the elongate housing.

2. A gantry crane for facilitating the removal and installation of hearth plates in an incinerator of the type including an elongate housing having opposite ends and a longitudinal axis, a door mounted for vertical movement at one end of the housing, an access opening at the other end of the housing, and a plurality of the hearth plates arranged to form a floor within the elongate housing, said gantry crane comprising:

a user-actuable lift mechanism adapted to individually engage and raise the hearth plates;

an elongate frame assembly having a first end and a second end, the elongate frame assembly being adapted to be inserted into the access opening and moved proximate to the one end of the housing; and the second end of the frame assembly having a horizontally extending support structure adapted to extend under the door mounted for vertical movement and to be firmly retained by the door so that the second end of the frame assembly is vertically supported by the horizontally extending support structure, and axial movement of the gantry crane is limited by the horizontally extending support structure, when the gantry crane is positioned for use.

3. A gantry crane for facilitating the removal and installation of hearth plates in an incinerator of the type including an elongate housing having opposite ends and a longitudinal axis, a door at one end of the housing, an access opening at the other end of the housing, and a plurality of the hearth plates arranged to form a floor within the elongate housing, said gantry crane comprising:

a user-actuable lift mechanism adapted to individually engage and raise the hearth plates; and an elongate frame assembly having a first end and a second end, the elongate frame assembly being adapted to be inserted into the access opening and moved proximate to the second end of the housing;

the second end of the frame assembly including structural members extending therefrom in a direction transverse to the longitudinal axis and adapted to engage the elongate housing and for preventing lateral movement of the gantry crane when it is positioned for use.

4. A gantry crane in accordance with claim 3 wherein said structural members are hingedly mounted to the second end of the frame assembly for selectively engaging the elongate housing.

5. A gantry crane comprising:

a winch;

means for supporting said winch for movement in a longitudinal direction including a longitudinally extending central beam having first and second ends, a generally hollow interior defining a elongated channel, and the beam having a bottom portion including an elongated slot extending along the length of the beam, the bottom portion of the beam including a first roller supporting surface on one side of the elongated slot and a second roller supporting surface on the other side of the elongated slot, first roller means supported by the first and second roller supporting surfaces and housed in the channel in the longitudinally extending central beam for longitudinal movement along the length of the central beam, and a winch supported by the first roller means and extending downwardly through the slot;

means for supporting the longitudinally extending central beam for movement in a lateral direction including first and second generally parallel, spaced apart, laterally extending end members, each of the end members having first and second ends, a generally hollow interior defining an elongated channel, and each end member having a bottom portion including an elongated slot extending along the length of the end member, the bottom portion of each end member including a first roller supporting surface one side of the elongated slot and a second roller supporting surface on the other side of the elongated slot, second roller means supported by the first and second roller supporting surfaces in the end member, trolley support means supported by the second roller means and extending downwardly through the slot, and a first trolley mechanism supported by the trolley support means of one of the end members and for movement in the direction of the length of the one of the end members, and a second trolley mechanism supported by the trolley support means of the other of the end members and for movement in the direction of the length of the other of the end members;

means for attaching the first end of the longitudinally extending beam to the first trolley mechanisms and the second end of the longitudinally extending beam to the second trolley mechanism.

6. A gantry crane in accordance with claim 5 further including first and second generally parallel, spaced apart side members, said first side member extending between and being attached to the first ends of the first and second generally parallel, spaced apart, laterally extending end members, respectively, and said second side member extending between and being attached to the second ends of the first and second generally parallel, spaced apart, laterally extending end members, respectively, to form a generally rectangular elongate frame.

7. A gantry crane in accordance with claim 6 wherein the first roller means comprises a plurality of journalled wheels, each of said journalled wheels including first and second rotatable portions and an axle, the first portion being separated from the second portion by the axle, the first rotatable portion of the journalled wheel rotatably supported by the first roller supporting surface and the second rotatable portion of the journalled wheel supported by the second roller supporting surface of the longitudinally extending central beam.

8. A gantry crane in accordance with claim 6 wherein said second roller means comprises a plurality of journalled wheels, each of said journalled wheels including first and second rotatable portions and an axle, the first portion being separated from the second portion by the axle, the first rotatable portion of the journalled wheel rotatably supported by the first roller supporting surface and the second rotatable portion of the journalled wheel supported by the second roller supporting surface of the end member.

9. A gantry crane in accordance with claim 6 further including detachable, vertically extending support means for vertically supporting the first and second ends of the first laterally extending end member.

10. A gantry crane in accordance with claim 8 wherein said vertically extending support means to support the first and second ends of the first laterally extending end member at an adjustable height.

11. A gantry crane in accordance with claim 9 wherein said vertically extending support means comprises a first and second vertically extending leg member, each of said vertically extending leg members having a length, an exterior surface, a generally hollow interior defining a channel extending in the direction of the length of the leg member, a slot extending along the channel in the leg member, the slot communicating between the hollow interior and the exterior surface of the leg member, a channel fastener in the leg member channel communicating through the slot, the channel fastener in each leg member supporting one of the first and second ends of the first extending end member at an adjustable height.

12. A gantry crane in accordance with claim 6 adapted for facilitating the removal and installation of hearth plates in an incinerator of the type including an elongate housing having opposite ends and a longitudinal axis, a door mounted for vertical movement at one end of the housing, an access opening at the other end of the housing, and a plurality of hearth plates arranged to form a floor within the elongate housing, said gantry crane further including vertically extending support means adapted to vertically support the first and second ends of the second laterally extending end member, the vertically extending support means having an axial movement restricting means extending horizontally therefrom and adapted to extend under the door mounted for vertical movement and to be engaged by the door mounted for vertical movement when the gantry crane is positioned within the elongate housing.

13. A gantry crane in accordance with claim 12 wherein the vertically extending support means includes brace means for selectively engaging the elongate housing of the incinerator to restrict lateral movement of said gantry crane when it is positioned in said incinerator.

14. A process for removing a hearth plate from an incinerator of the type including an elongate housing having first and second ends, a longitudinal axis, and an access opening at the first end of the housing, and a plurality of hearth plates arranged to form a floor within the elongate housing, comprising the steps of:

providing a gantry crane having a user-actuable lift mechanism comprising an elongate frame assembly with a first end and a second end;

inserting the second end of the elongate frame assembly into the access opening, and moving the second end of the gantry crane frame assembly proximate the second end of the housing;

causing the lift mechanism to engage the hearth plate to be removed;

causing the lift mechanism to rise thereby raising the hearth plate to be removed;

causing the lift mechanism to move the hearth plate proximate to the first end of the gantry crane.

15. A process in accordance with claim 14 further including the step of providing means for horizontally supporting the first end of the elongate frame assembly after inserting the second end of the gantry crane frame assembly into the access opening and before causing the lift mechanism to engage the hearth plate to be removed.

16. A process for removing a hearth plate from an incinerator of the type including an elongate housing having first and second ends, a longitudinal axis, a first opening at the first end of the housing, a second opening at the second end of the housing, and a plurality of hearth plates arranged to form a floor within the elongate housing, comprising the steps of:

providing a gantry crane having a user-actuable lift mechanism comprising an elongate frame assembly with a first and second end, the gantry crane having an appropriate width to allow the second end of the frame assembly to the inserted into the first opening and moved through the housing so as to protrude through the second opening of the housing and having sufficient length to allow the first end of the frame assembly to protrude through the first opening of the housing while the second end of the frame assembly protrudes through the second opening of the housing;

inserting the second end of the elongate frame assembly into the first opening and moving the second end of the elongate frame assembly through the housing to protrude through the second opening of the housing while the first end of the frame assembly protrudes from the first opening of the housing;

causing the lift mechanism to engage the hearth plate to be removed;

causing the lift mechanism to rise thereby raising the hearth plate to be removed;

causing the lift mechanism to move the hearth plate to the first end of the gantry crane.

17. A process in accordance with claim 16 further including the step of providing means for horizontally supporting the first and second ends of the elongate frame assembly after inserting the second end of the frame assembly into the first opening and before causing the lift mechanism to engage the hearth plate to be removed.

18. A process for removing a hearth plate from an incinerator of the type including an elongate housing having first and second ends, a longitudinal axis, a first opening at the first end of the housing, a second opening at the second end of the housing, a door mounted for vertical movement exterior to the second end of the housing for selectively blocking the opening and a plurality of hearth plates arranged to form a floor within the elongate housing, comprising the steps of:

providing a gantry crane having a user-actuable lift mechanism comprising an elongate frame assembly with a first and second end, the gantry crane having an appropriate width to allow the second end of the frame assembly to be inserted into the first opening and moved through the housing and having sufficient length to allow the first end of the frame to protrude through the opening at the first end of the housing while the second end of the frame assembly is clamped by the door mounted for vertical movement;

inserting the second end of the elongate frame assembly into the first opening, moving the second end of the elongate frame assembly through the housing to protrude through the second opening of the housing and lowering the vertically moving door thereon;

causing the lift mechanism to engage the hearth plate to be removed;

causing the lift mechanism to rise thereby raising the hearth plate to be removed;

causing the lift mechanism to move the hearth plate proximate to the first end of the gantry crane.

19. A process in accordance with claim 18 further including the step of providing means for horizontally supporting the first end of the elongate frame assembly after inserting the second end of the elongate frame assembly into the first opening and before causing the lift mechanism to engage the hearth plate to be removed.

* * * * *